US005256203A

United States Patent [19]

Moore et al.

[11] Patent Number: 5,256,203

[45] Date of Patent: Oct. 26, 1993

[54] ADHESIVE FOR APPLYING A FLUID ADHESIVE TO THE INSIDE SURFACES OF CARTRIDGE CASES ADJACENT THEIR OPEN PROJECTILE-RECEIVING ENDS

[75] Inventors: Thomas B. Moore, Chesterfield; Kevin E. Craig, St. Ann; Gerard J. Gragnani, Florissant, all of Mo.

[73] Assignee: Thomas B. Moore Co. Inc., Maryland Heights, Mo.

[21] Appl. No.: 750,881

[22] Filed: Aug. 26, 1991

[51] Int. Cl.[5] ..... B05C 7/00

[52] U.S. Cl. ..... 118/698; 118/44; 118/705; 118/302; 118/315; 118/408; 118/410; 118/500; 118/DIG. 10; 141/346; 141/368; 141/388; 29/1.3; 72/45; 72/46

[58] Field of Search ..... 118/408, 410, 302, 315, 118/313, 696, 698, 705, 500, DIG. 10, 44, 254; 141/130, 242, 346, 368, 383, 386; 29/1.3, 1.31, 422; 72/43, 44, 45, 46

[56] References Cited

U.S. PATENT DOCUMENTS

| | | | |
|---|---|---|---|
| 2,412,954 | 12/1946 | Zdancewicz | 118/408 |
| 2,562,871 | 7/1951 | Palermo | 118/DIG. 10 |
| 2,960,060 | 11/1960 | Chatterton | 118/315 |
| 3,020,578 | 2/1962 | O'Connor | 118/410 |
| 3,077,857 | 2/1963 | Widner | 118/315 |
| 3,111,431 | 11/1963 | Weaver | 118/408 |
| 3,250,247 | 5/1966 | Beaman | 118/315 |
| 3,817,210 | 6/1974 | Greever | 118/408 |
| 3,899,998 | 8/1975 | Davies et al. | 118/408 |
| 3,956,533 | 5/1976 | Weber et al. | 118/408 |
| 4,225,638 | 9/1980 | Waugh | 118/410 |
| 4,458,628 | 7/1984 | Fuji et al. | 118/698 |
| 4,515,187 | 5/1985 | Schaumberg et al. | 118/680 |
| 4,532,151 | 7/1985 | Stenlund | 118/408 |

FOREIGN PATENT DOCUMENTS

| | | | |
|---|---|---|---|
| 2386399 | 12/1978 | France | 118/408 |
| 2601888 | 1/1988 | France | 118/315 |

*Primary Examiner*—W. Gary Jones
*Assistant Examiner*—Todd J. Burns
*Attorney, Agent, or Firm*—Senniger, Powers, Leavitt & Roedel

[57] ABSTRACT

Apparatus for applying an anaerobic adhesive to the inside of the necks of cartridge cases preparatory to insertion of bullets therein to provide a seal between the inside of the necks and the bullets, the cases being held standing on end, mouth end up, in a holder arranged in a rank and file format, the holder being indexed to bring successive rows of cases under a set of adhesive dispensing nozzles which are lowered for entry of the tips of the nozzles into the upper ends of the cases in a row.

12 Claims, 9 Drawing Sheets

ADHESIVE FOR APPLYING A FLUID ADHESIVE TO THE INSIDE SURFACES OF CARTRIDGE CASES ADJACENT THEIR OPEN PROJECTILE-RECEIVING ENDS

BRIEF SUMMARY OF THE INVENTION

This invention relates to adhesive applying apparatus, broadly to apparatus for dispensing a quantity of adhesive and wiping or spreading it over a surface of an object for providing a seal between that surface and a surface of another object, and particularly to apparatus for applying an anaerobic adhesive in the open ends of cartridge cases (shells) for ammunition after they have been loaded with propellant (powder) and before projectiles (bullets) are inserted in the open ends of the cases, the adhesive acting after it has anaerobically cured to provide a seal around the projectile to protect the propellant in the cases from moisture.

Among the several objects of the invention may be noted the provision of improved apparatus of the class described, and in particular the provision of apparatus for automatically applying adhesive in the open ends of cartridge cases in mass production; the provision of such apparatus particularly adapted for the application of anaerobic adhesive in the open ends of cartridge cases at substantial production rates; the provision of such apparatus adapted for operation to apply adhesive in the open ends of cases for different calibers of ammunition; and the provision of such apparatus adapted for ready flushing of adhesive from the apparatus at the end of a production period.

In general, apparatus of this invention for applying an adhesive in a fluid state to the inside surface of cartridge cases adjacent their open projectile-receiving ends (their mouth ends) preparatory to insertion of projectiles (bullets) therein to provide a seal between said surface and the projectile comprises a set of adhesive dispensing nozzles at an adhesive applying station, means mounting the set of nozzles for movement between a raised position for bringing a set of cases under the nozzles and a lowered position wherein the nozzles are entered at their lower ends in the open upper ends of said set of cases, and means for moving said nozzle mounting means up and down for raising and lowering the nozzles. A source of adhesive under pressure is interconnected with the nozzles by interconnecting means including valve means for on-off control of flow of adhesive from the source to the nozzles. Means is provided operable with the nozzles raised for bringing a set of cases into position under the nozzles at the adhesive applying station. Each nozzle is formed adjacent its lower end with a peripheral recess and has passaging for delivery of adhesive to the recess, means being provided for controlling the valve means to deliver adhesive to the recess of each nozzle for wiping of the adhesive on said inside surfaces of the cases as the nozzles are raised.

The principles of the invention may be more broadly applicable to apparatus for applying a flowable material to a surface of a workpiece generally, the apparatus then comprising a material dispensing nozzle at an applying station, the nozzle having a surface generally matching said workpiece surface, means for positioning a workpiece at the applying station, and means mounting the nozzle for movement between a retracted position relative to the workpiece at the applying station and an advanced position wherein said nozzle surface is contiguous to said workpiece surface with said nozzle surface being slidable relative to said workpiece surface. The nozzle has a recess in said nozzle surface extending crosswise thereof and passaging for supplying material to the recess. A source of the material under pressure is interconnected with the nozzle, the interconnecting means including valve means for on-off control of flow of the material to the passaging and thence to the recess in said nozzle surface. Means is provided for controlling the valve means to deliver material to the recess in the nozzle for application to said workpiece surface, the material being wiped by said nozzle surface over said workpiece surface as the nozzle is retracted.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
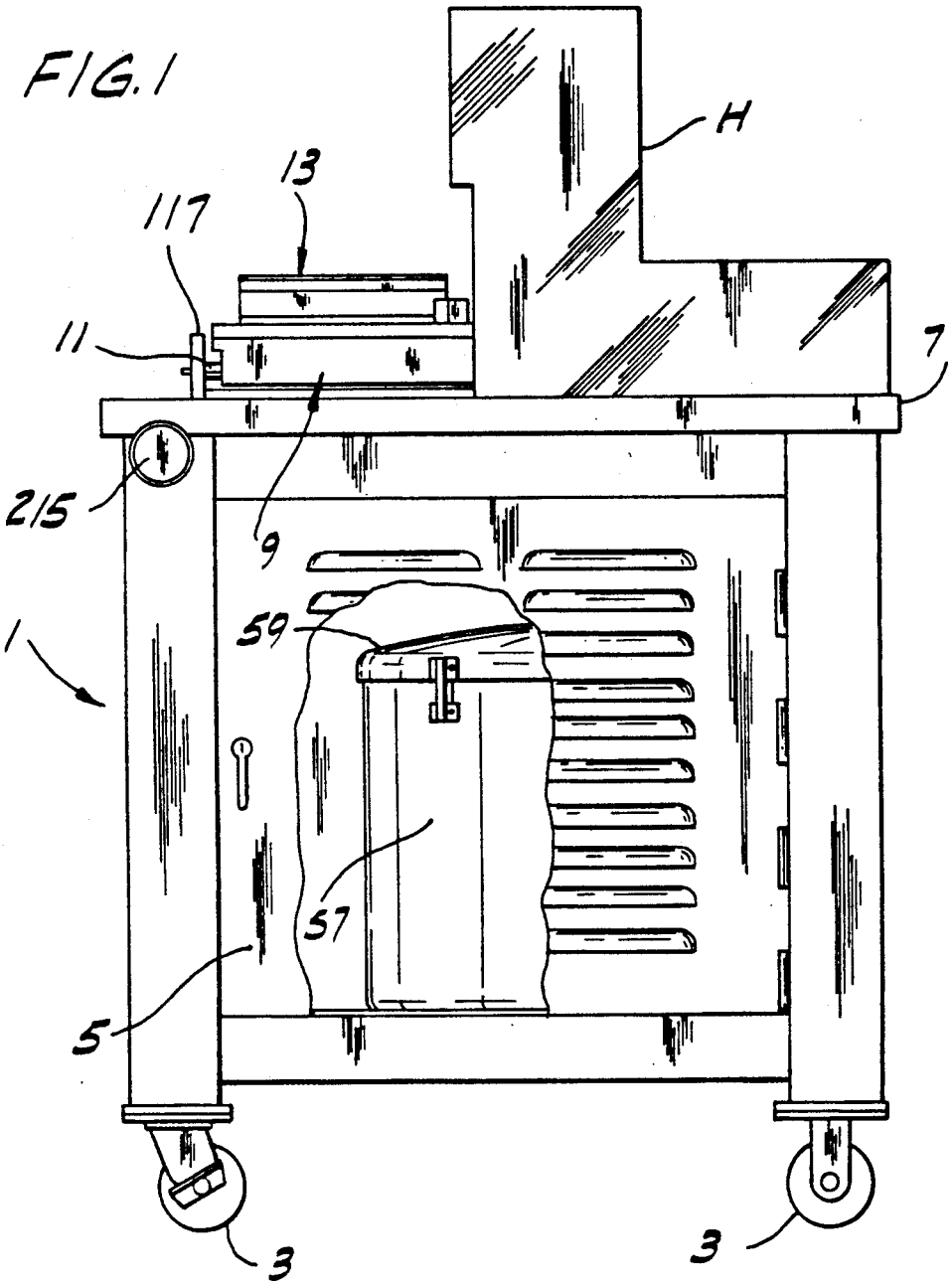
FIG. 1 is a view in side elevation of apparatus of this invention for applying adhesive as above described to cartridge cases.
Figure 2:
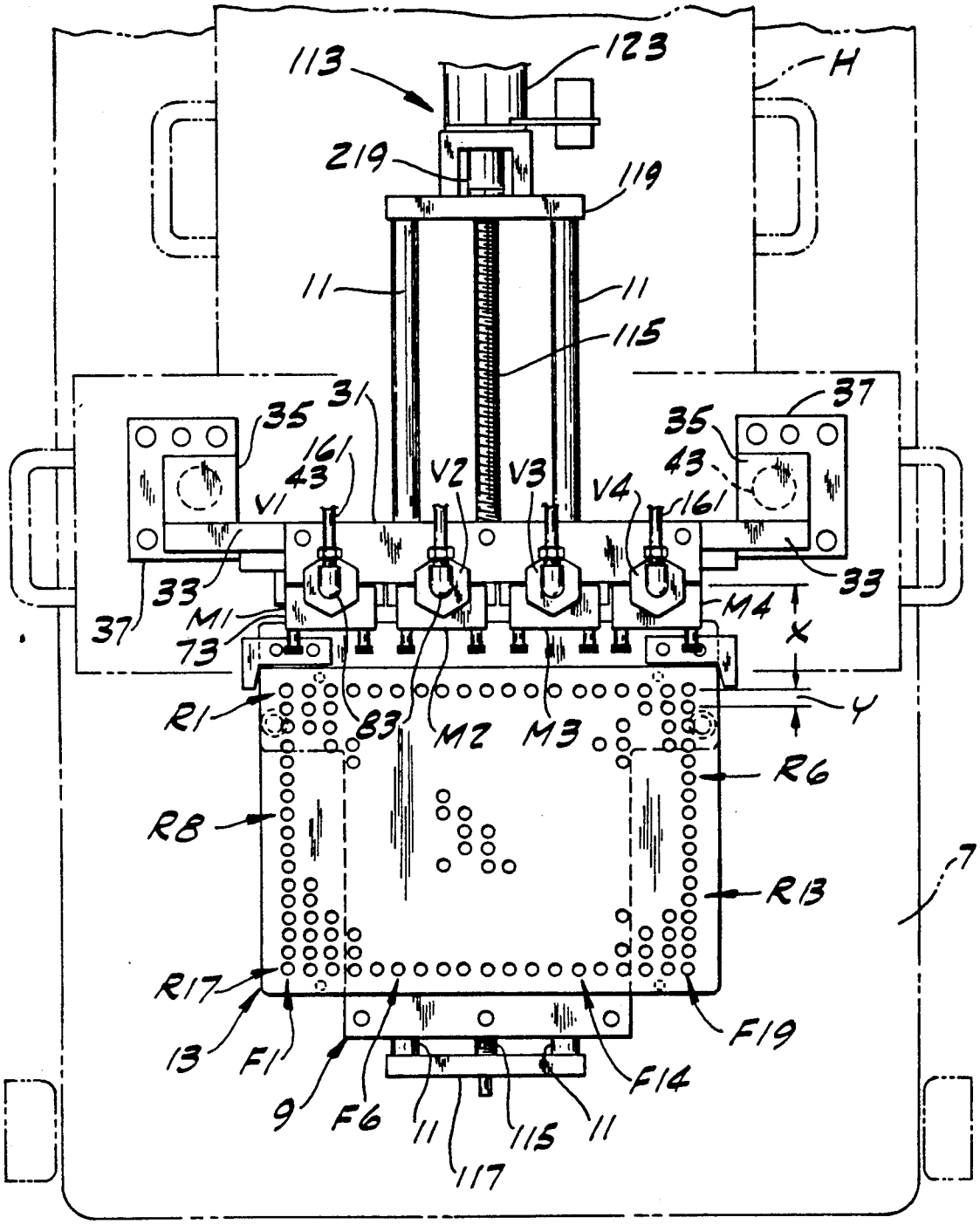
FIG. 2 is a plan view, certain housing structure being removed, the outline of the housing structure being shown in phantom.
Figure 3:
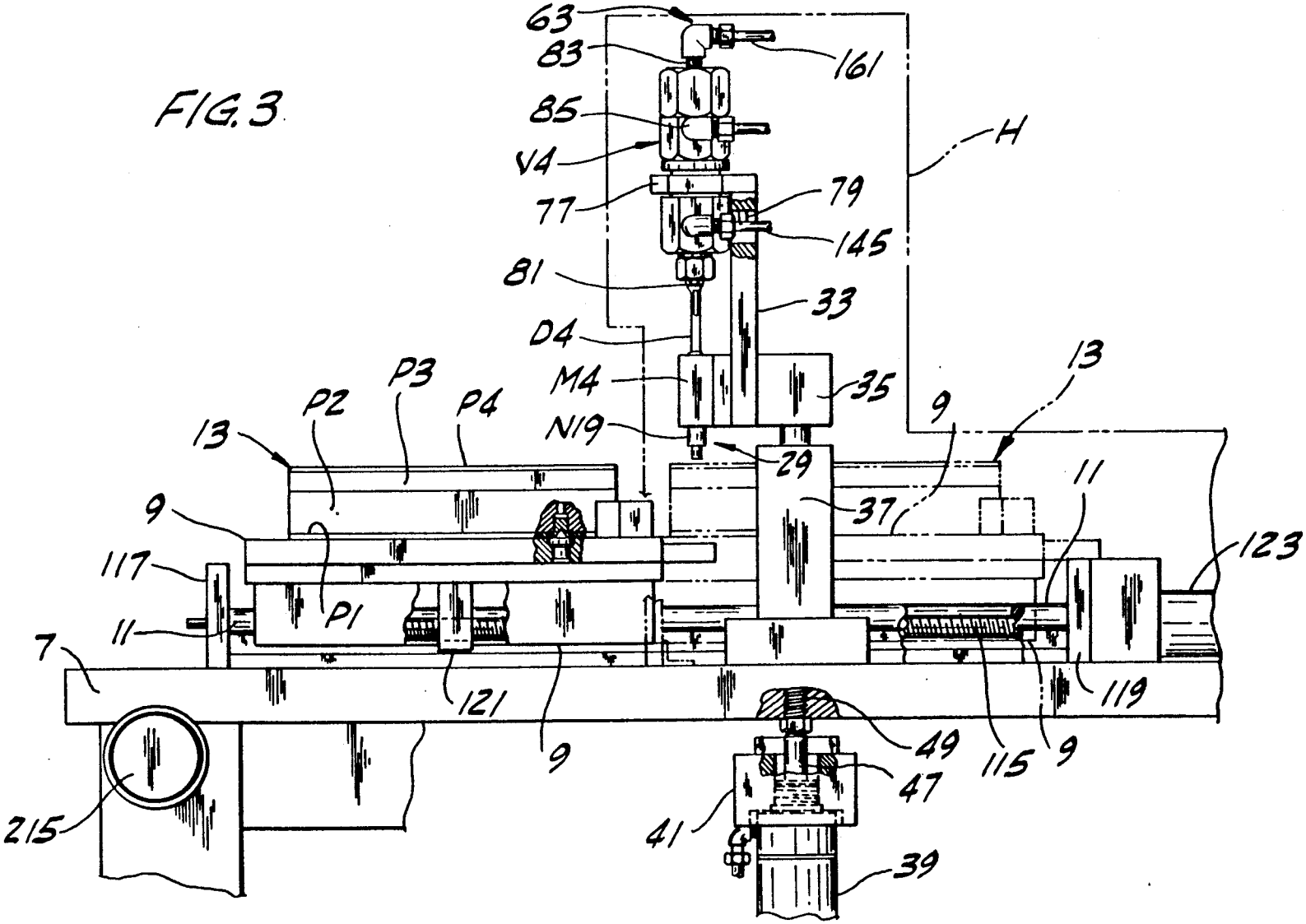
FIG. 3 is a side elevation of the upper part of the apparatus as viewed from the side shown in FIG. 1, showing the outline of the housing structure, certain parts being partly broken away and shown in section.
Figure 4:
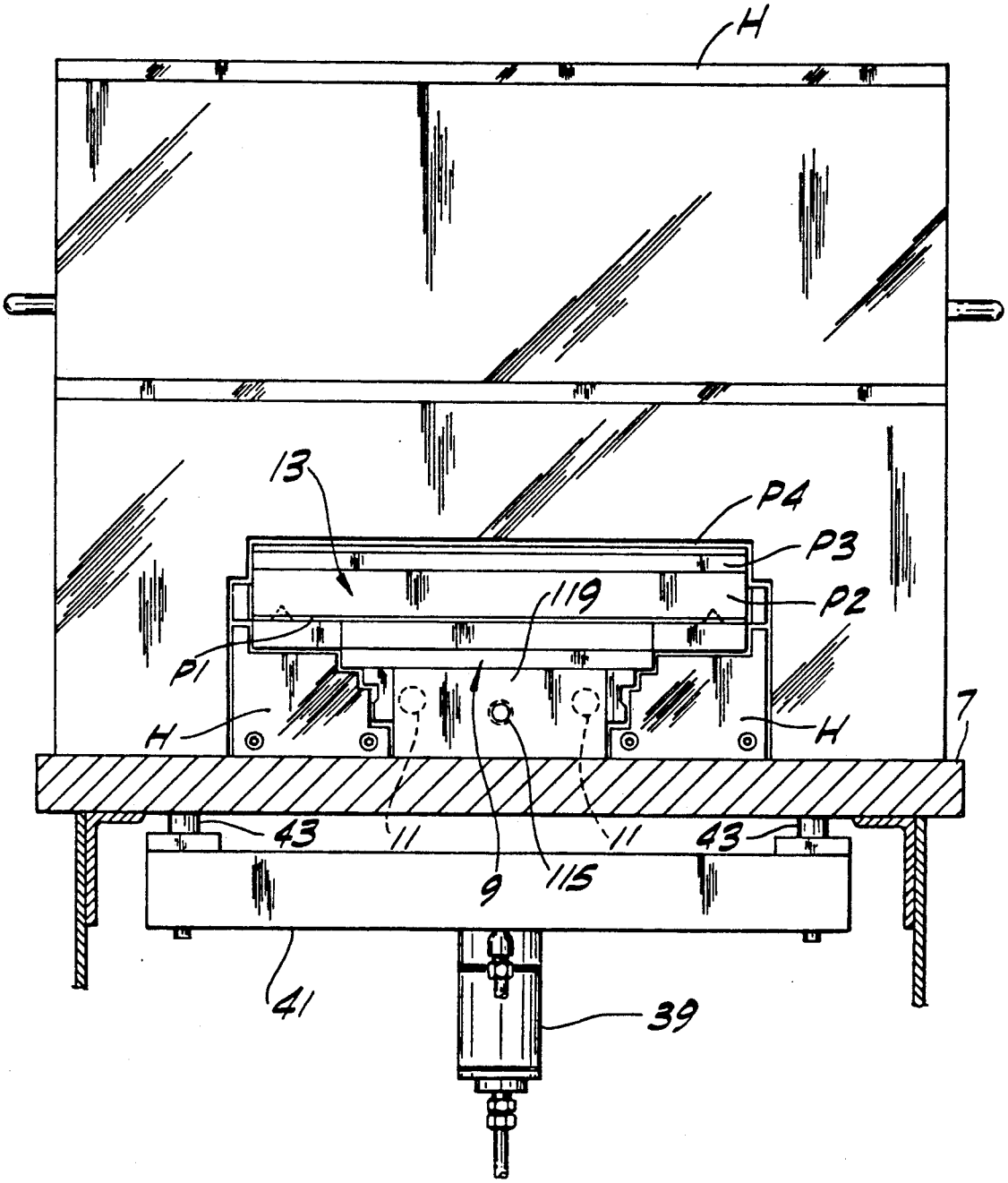
FIG. 4 is a front elevation of the upper part of the apparatus, showing the housing structure, certain parts being broken away and shown in section.
Figure 5:
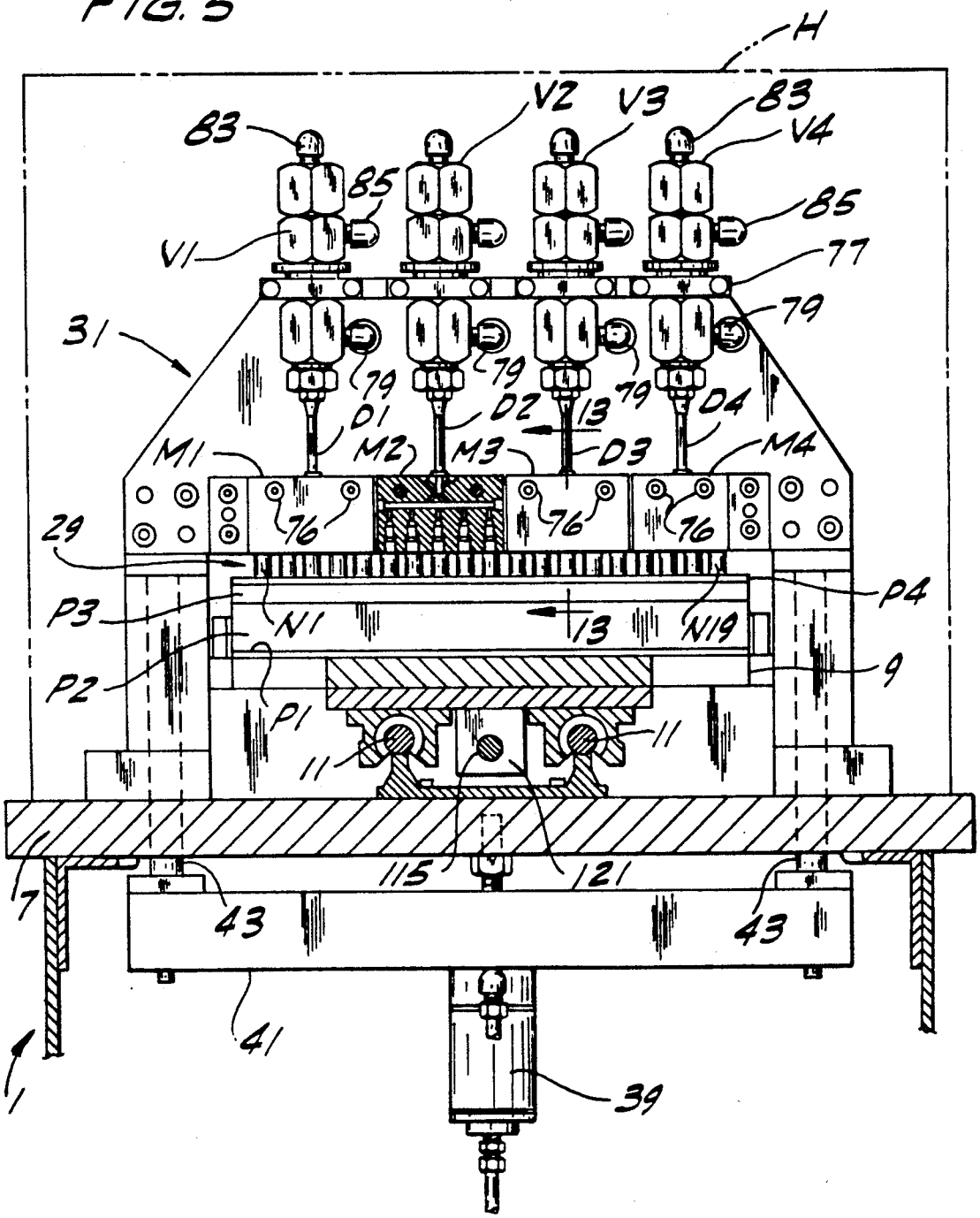
FIG. 5 is a view similar to FIG. 4 with the housing structure removed.

Referring to the drawings, first more particularly to FIGS. 1-5, apparatus of this invention is shown generally to comprise a cabinet structure indicated generally at 1 on casters 3 having a door 5 at one side and a top 7 at such height above the floor as to constitute a table top. A carriage 9 is mounted for endwise sliding linear movement on a pair of rails 11 mounted on the table top 7 extending parallel to one another from adjacent the front to adjacent the rear of the table top. The carriage is movable linearly in a generally horizontal path from the forward position in which it is shown in FIGS. 2 and 3 adjacent the front of the table top 7, constituting what may be referred to as its retracted or home position, to the extended rearward position in which it is indicated in phantom in FIGS. 2 and 3 adjacent the rear of the table top, and movable back to the home position. At 13 is indicated means on the carriage for holding a plurality of cartridge cases C standing on end with the open mouth end (the projectile end) of each case up. At H is indicated housing structure on top of the cabinet 1.

The case holding means or holder 13, which may also be referred to as the case magazine 13, comprises an assembly of four plates P1-P4, P1 being a relatively thin bottom plate, P2 being a relatively thick plate on the bottom plate, P3 being a plate of intermediate thickness on plate P2, and P4 being a relatively thin top plate on plate P3. The plate P2 has a plurality of holes 15 extending through it from top to bottom having a diameter slightly larger than the outside diameter of the body of a cartridge case C to be held therein (see FIG. 13). Plate P1 has a plurality of holes 16 therein coaxial with and of smaller diameter tha the holes 15, providing a shoulder on which rims Cr of the cartridge cases rest. Plate P3 has a plurality of holes 17 coaxial with the holes 15 accommodating the flared shoulder Cs of the cartridge case, and plate P4 has a plurality of holes 18 therein each having a diameter slightly greater than the outside of the neck Cn of a cartridge case. Plate P4 is of slightly greater thickness than the length of the neck Cn of the cartridge case C and thus a case C, as mounted in the case holder 13 standing on end in the holes in the holder with its rim end resting on plate Pl has its upper end slightly below the upper face of the top plate P4 (see FIG. 13). The plates are held in registration for alignment of each hole 16 in plate P1 with a respective hole 15 in plate P2, a respective hole 17 in plate P3 and a respective hole 18 in plate P4, by means of registration pins and openings such as indicated at 19 in FIG. 6. Each cartridge case C is held accurately in place in the respective set of holes 15, 17 and 18 in the case holder as assembled.

It will be understood that each case C in the case holder 13 will have been loaded with propellant (powder) P (see FIG. 13) preparatory to insertion of a projectile (a bullet) in its open end. As herein illustrated, the holder has three hundred and twenty-three sets of holes (each set comprising a hole 15, a hole 17 and a hole 18) for holding three hundred and twenty-three cases arranged in a rectangular rank and file format comprising a plurality of rows, more particularly seventeen rows each generally designated R and specifically designated R1-R17 with nineteen sets of holes in each row R and with each row R extending parallel to one of the long edges (the longitudinal edges) of the holder 13 and transversely of the path of the carriage 9 as the holder 13 is mounted on the carriage, and nineteen rows each generally designated F and specifically designated F1-F19 extending at right angles to the transverse rows R1-R17 and longitudinally of the path of the carriage. The nineteen-hole transverse rows R1-R17 constitute the ranks of the rank and file format and the seventeen-hole longitudinal rows F1-F19 constitute the files of the rank and file format. The rows R1-R17 are parallel to one another extending at right angles relative to the path of the carriage 9 and the rows F1-F19 are parallel to one another extending in the direction of the path of the carriage. The cases in the transverse rows R1-R17 (the ranks) are spaced at file intervals transversely of the path of the carriage and the cases in the longitudinal rows F1-F19 (the files) are spaced at rank intervals longitudinally of the path of the carriage. It will be understood that, as placed in the holder 13 for the application of the adhesive to the inside surface of the cases adjacent their open ends at Cn preparatory to insertion of projectiles (bullets) in the open ends of the cases, the cases have already been loaded with propellant P.

Figure 6:
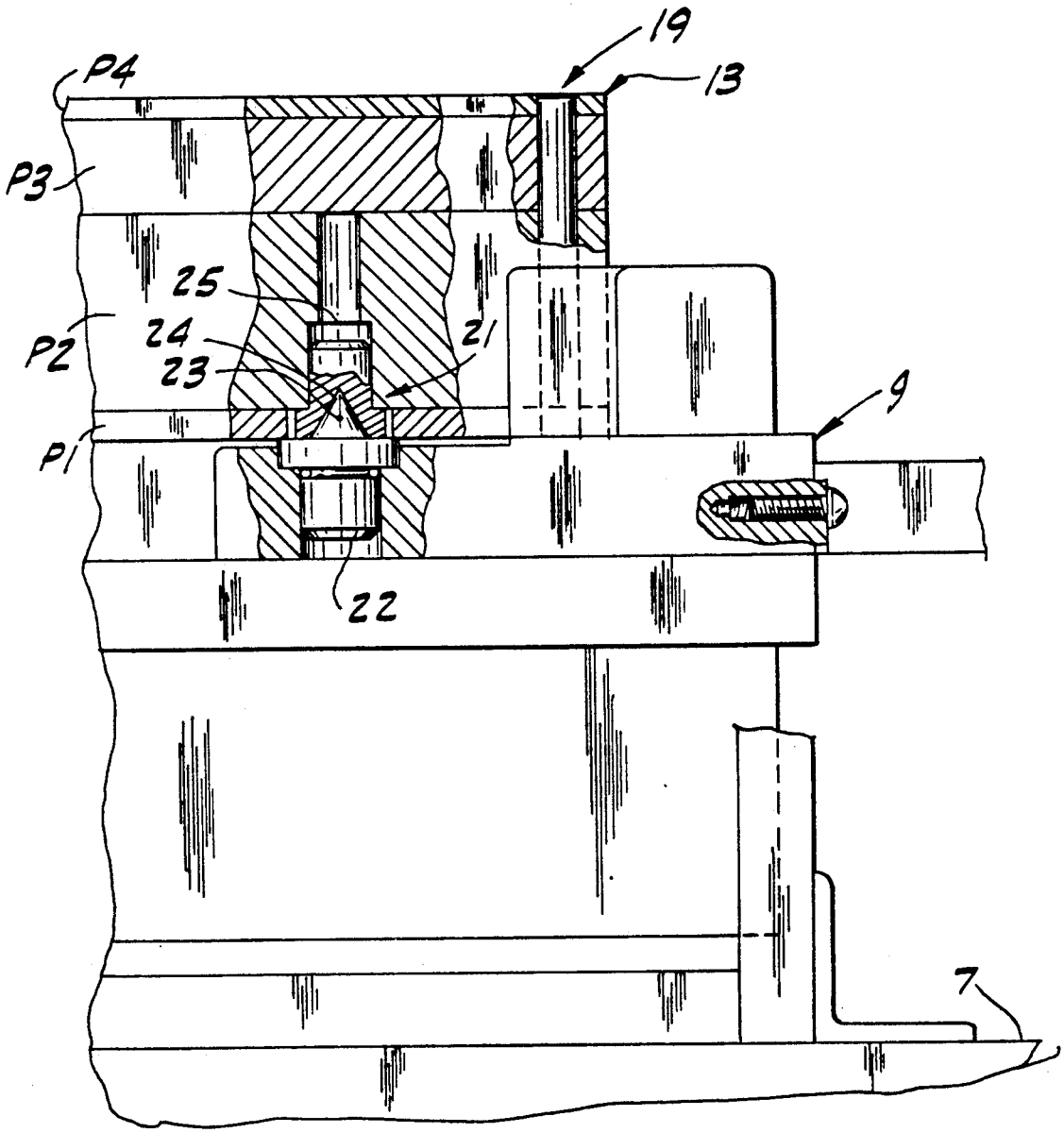
FIG. 6 is a view showing in section how a cartridge case holder is mounted in registered position on a carriage of the apparatus.
Figure 7:
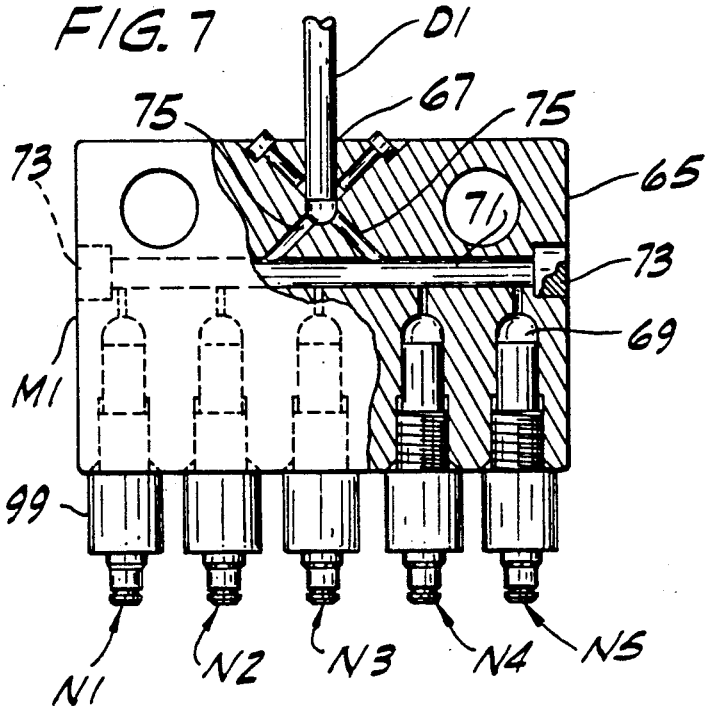
FIG. 7 is a view in front elevation of a nozzle manifold and nozzles secured thereto, the manifold being broken away and shown partly in section.
Figure 10:
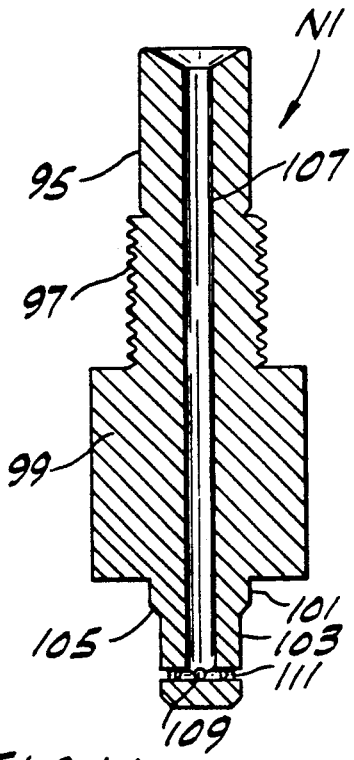
FIG. 10 is a longitudinal section of a nozzle.
Figure 8:
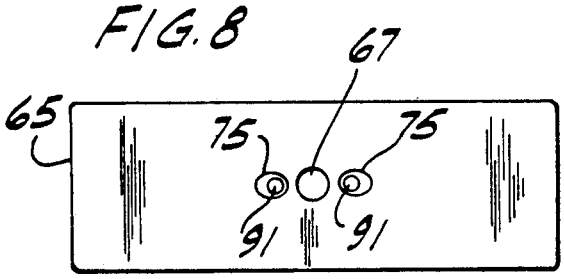
FIG. 8 is a plan of the manifold shown in FIG. 7.
Figure 11:
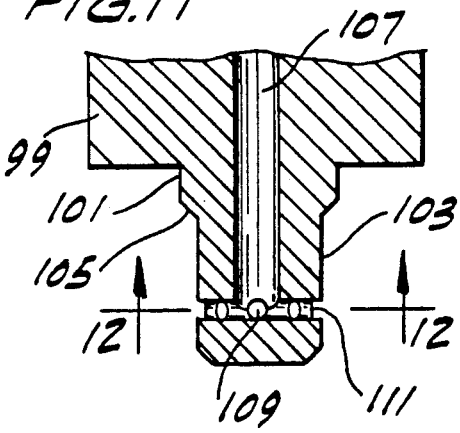
FIG. 11 is an enlargement of the lower end of FIG. 10.
Figure 9:
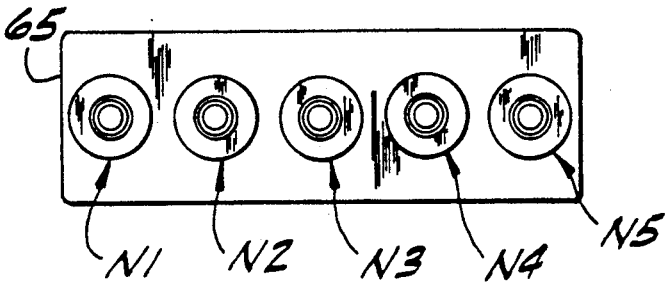
FIG. 9 is a bottom plan of FIG. 7 showing the nozzles.
Figure 12:
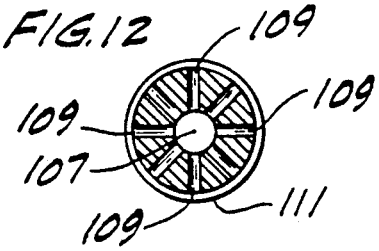
FIG. 12 is a transverse section of the nozzle taken on line 12—12 of FIG. 11.

The case holder 13 and the carriage 9 have means such as indicated generally at 21 in FIG. 6 for maintaining the case holder 13 on the carriage 9 in a position of accurate registration of the cases held in the holes in the case holder relative to a set 29 of adhesive (sealant) dispensing nozzles to be described. For this purpose, as illustrated, means 21 comprises upwardly extending registration pins 22 on the carriage 9 having conical upper ends 23 which fit in matching conical registration recesses 24 in members 25 at the bottom of the case holder.

The set 29 of adhesive dispensing nozzles comprises one nozzle for each case C in a transverse row R of cases (i.e. one nozzle for each file of casings). Each nozzle is generally designated N and with nineteen files, there are nineteen nozzles N1-N19 in the set. The nozzles are mounted on means indicated generally at 31 with the nozzles arranged side-by-side in a generally vertical plane extending transversely of the path of the carriage 9 with the nozzles extending downwardly and movable generally vertically between a raised position (see FIG. 3) wherein the lower ends of the nozzles are above the level of the upper surface of plate P4 on the carriage, and a lowered position (see FIGS. 5 and 13) wherein the tips of the nozzles are entered in the upper ends Cn of the nineteen cases C in a transverse row R of the cases. The nozzle mounting means 31 comprises a crosshead 33 extending transversely with respect to the table top (transversely with respect to the path of the carriage 9) over the path of the case holder 13 on the carriage, the crosshead having end members 35 which are above guides 37 extending up from the table top 7 at opposite sides of the path of the case holder 13 as it moves rearward and then back forward with the carriage 9. The crosshead 33, carrying the nozzles, is movable up and down by means comprising an air cylinder 39 secured to a yoke 41 extending transversely below the table top 7 with connecting rods 43 extending up from the ends of the yoke through holes in the table and through the guides to connections with the crosshead end members 35. The piston 47 of the cylinder 39 extends up from the cylinder and has its upper end threaded in a tapped hole in the table top 7 as indicated at 49 in FIG. 3.

At 57 (see FIGS. 1 and 15) is indicated a pressure vessel housed in the cabinet 1 for holding a supply of fluid adhesive to be applied to the inside surfaces of the upper ends i.e. necks Cn of cases C, for the sealing of the neck ends of the cases around the projectiles (bullets) subsequently inserted into and held therein. The latter step is a separate step, which may involve a conventional procedure for pressing projectiles in the open mouth ends of the cases, and its details are not critical insofar as this invention is concerned. The pressure vessel has a lid 59 which is opened for filling the vessel with the adhesive, which may be any of a number of commercially available anaerobic adhesives such as conventionally used for sealing purposes. Adhesive in the pressure vessel is pressurized with air under pressure supplied to the vessel in a manner to be described. Means indicated generally at 63 in FIG. 15 interconnects the pressure vessel to the nozzles N1–N19, including a set of valves V1–V4 for on-off control of the flow of adhesive from the pressure vessel to and out of the nozzles, and a set of manifolds M1–M4 supplied by the respective valves, each manifold supplying a subset of the nozzles N1–N19. Thus, valve V1 provides on-off control of flow of adhesive to manifold M1 which supplies nozzles N1–N5, valve V2 provides on-off control of flow of adhesive to manifold M2 which supplies nozzles N5–N10, valve V3 provides on-off control of flow of adhesive to manifold M3 which supplies nozzles N11–N15, and valve V4 provides on-off control of flow of adhesive to manifold M4 which supplies nozzles N16–N19.

As herein illustrated, the case holder 13 holds nineteen cases C side-by-side in each transverse row R (i.e. in each rank), one case trailing another in each longitudinal row (i.e. in each file F). For application of adhesive to the nineteen cases in each transverse row R, the four manifolds M1–M4 are mounted in side-by-side position on the crosshead 33, each of manifolds M1–M3 supplying five nozzles and manifold M4 supplying four nozzles, for the total of nineteen. Valves V1–V4 are interconnected with manifolds M1–M4, respectively, by adhesive delivery lines each generally designated D and specifically designated D1–D4. Each of the manifolds M1–M4 comprises a block 65, which may be a plastic or metal block, of rectangular conformation having an inlet opening 67 at the top. Each block M1–M3 has five nozzle-receiving outlet openings 69 at the bottom; block M4 has four. Each block has a manifold passage 71 extending crosswise thereof plugged at its ends as indicated at 73. Adhesive is supplied from the inlet opening 67 via angled passages 75 which intersect at the passage 71. The four manifolds M1–M4 are mounted side-by-side on the front face of the crosshead 33 in line across the crosshead by screws as indicated at 76. The valves V1–V4 are clamped as indicated at 77 on the front face of the crosshead each directly above a respective manifold. Each valve is an air-operated valve, having an inlet 79 to which is connected a flexible line 145 for delivery of adhesive from the pressure vessel 57 to the valve, an outlet 81 at its lower end, and ports 83 and 85 for control air. The outlets 81 of the valves are connected to the manifolds M1–M4 by the stated lines D1–D4 each extending down into the inlet opening 67 in the respective manifold in the top of the respective manifold, each line D being held at its lower end in the respective opening 67 by pins 91 pressed into the angled passages 75 at their upper ends . Each valve V1–V4 may be a commercially available air-operated valve such as adapted to dispense adhesive through the respective line D to the respective manifold M and thence to the nozzles N of the subset of nozzles served by that manifold when activated and to cut off the delivery of adhesive when deactivated. Delivery of the adhesive is on a time/pressure basise, each valve having an adjustment for adjusting the delivery during a unit period of time. Each valve also has a snuff-back feature for snuffing back adhesive when the valve is deactivated. Particularly suitable is a Model No. 400.04.00 valve sold by Dopag Corporation of Switzerland and having U.S. headquarters in Round Lake, N.Y.

Each of the nozzles N1–N19 comprises an elongate body 93 having an upper cylindric section 95 screw-threaded as indicated at 97 for being removably threaded in an outlet hole 69 (which is tapped) in the bottom of a manifold M, an intermediate enlarged section or head 99 to which a tool may be applied for turning the nozzle to screw it into or out of hole 69, and a lower section 101 extending down from the head 99, all of these being coaxial. The lower section has a lower cylindrical end portion or tip 103 having a diameter slightly smaller than the internal diameter of the neck Cn of a cartridge case (to the inside surface of which adhesive is to be applied). For example, for a cartridge case for a 5.56 mm caliber ammunition as to which the inside diameter of the neck of the case is 0.24" and the outside diameter of the tip 103 is 0.210"–5.334 mm. The tip extends down from a chamfered root section 105 at the lower end of the head 99 adapted to spread the mouth of any case which may need spreading (this function being known as "mouth-ironing" the case and also adapted to seal the mouth against escape of adhesive. The nozzle has an axial passage 107 extending down from its upper end toward but terminating short of its lower end, and radial passages 109 from this axial passage to an annular peripheral recess or groove 111 in the tip of the nozzle adjacent its lower end (below the chamfer).

Means indicated generally at 113 for driving the carriage 9 is shown to comprise a drive screw 115 journalled at 117 and 119 extending parallel to the guide rails 11 between the rails threaded in a nut 121 on the bottom of the carriage and a reversible stepping motor 123 mounted on the table top 7 for driving the screw. The arrangement is such that on driving the screw in one direction the carriage is moved rearward (toward the right as viewed in FIGS. 1 and 3), and on driving it in the opposite direction the carriage is moved forward.

Figure 15:
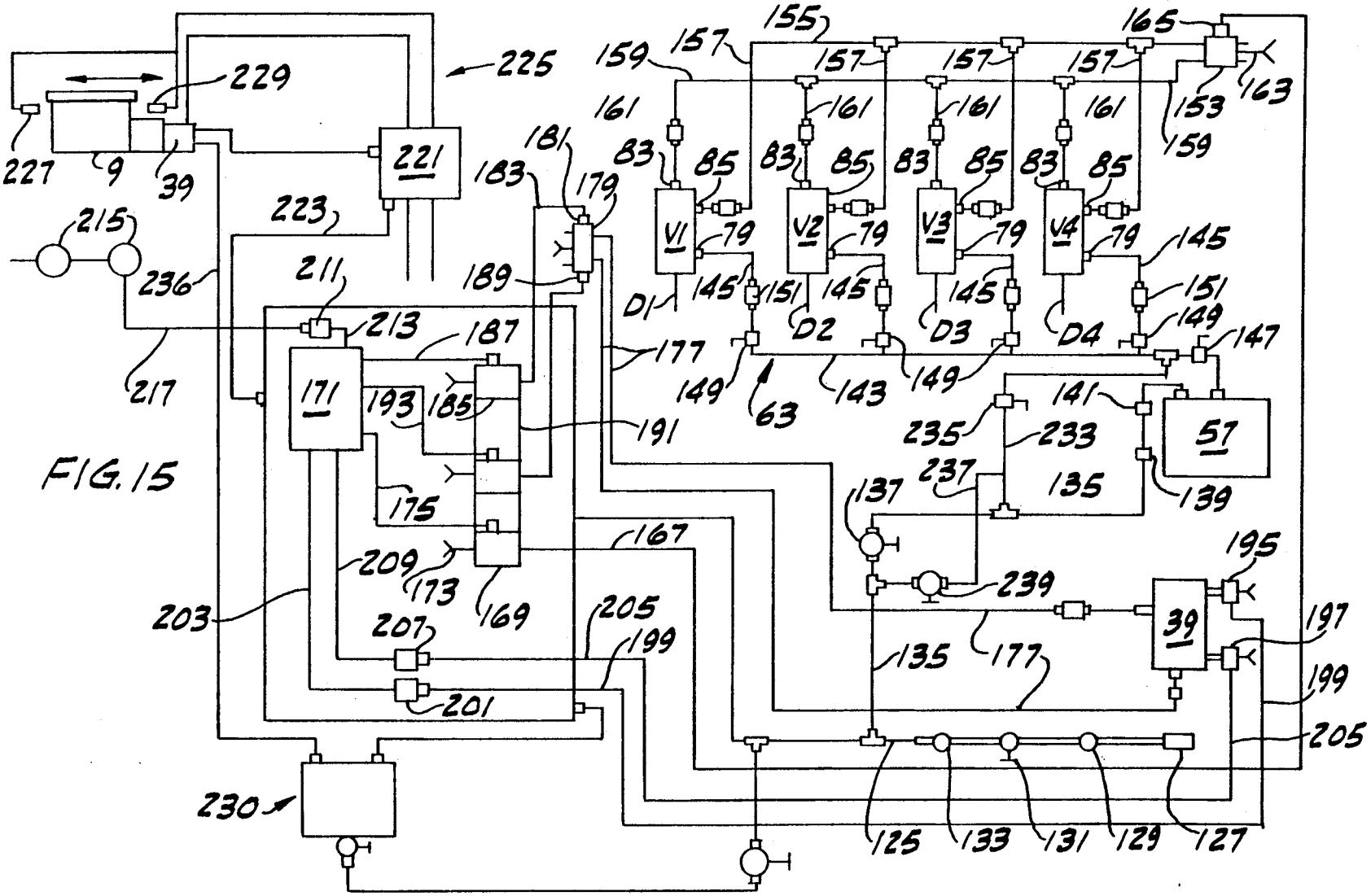
FIG. 15 is a circuit diagram.

Referring to the FIG. 15 diagram there is indicated at 125 a compressed air supply line having a quick coupling at 127 for connection to a source of air (shop air) under pressure. Line 125 includes a filter 129, a pressure regulator 131 and a de-oiler 133. An air line 135 including a pressure regulator 137, a shut-off valve 139 and a flow control valve 141 interconnects supply line 125 and the pressure vessel 57, supplying air under pressure to the vessel for pressurizing adhesive therein. A line 143 of the aforesaid means 63 leads from the pressure vessel 57 to four flexible branch lines each designated 145 (see above) for delivery of adhesive under pressure from the pressure vessel to the inlets 79 of the four air-operated adhesive dispensing valves V1–V4. Line 143 includes a shut-off valve 147 and each branch line 145 includes a shut-off valve 149 and a flow control valve 151. At 153 is indicated a four-way solenoid valve for controlling the supply and exhaust of control air to and from the control ports 83 and 85 of the dispensing valves V1–V4. An air line 155 connected to a first port of valve 153 has four flexible branch lines 157 interconnected with ports 85 of the dispensing valves, and an air line 159 connected to a second port of valve 153 has four flexible branch lines 161 interconnected with ports 83 of the dispensing valves. Valve 153 is of a commercially available type supplied with air at 163 via an air supply circuit (not shown), having a control port indicated at 165 adapted for delivery of control air via a control air line 167. It functions when air to port 165 is off to supply air via lines 155 and lines 157 to valves V1–V4 and to exhaust air via lines 161 and line 159 from these valves to hold them closed, and functions on delivery of a control air signal via line 167 connected to port 165 to deliver air via line 159 and lines 161 to the valves V1–V4 and to exhaust air via lines 157 and line 155 to open the valves for delivery of adhesive from the pressure vessel 57 to the nozzles N1–N19. Delivery of control air to port 165 of valve 153 via line 167 is from a valve 169 under control of a programmable logic controller, (PLC) 171 which controls various air-operated components of the apparatus as will appear. Valve 169 is supplied with air at 173 for delivery to line 167 via the air supply circuit (not shown). It is activated to deliver air via line 167 to port 165 of valve 153 on receiving an electrical signal via line 175 from the controller 171, the timing being such (in relation to the pressure on the adhesive in the pressure vessel) as to provide for delivery of a relatively small metered quantity of adhesive by each valve V1–V4 to the four manifolds M1–M4 and thence to the nozzles N1–N19. Typically, each valve V1–V4 is opened for 0.2 second with 15–18 psi pressure.

The air cylinder 39 for raising and lowering the crosshead 33 carrying the valves V1–V4, manifolds M1–M4 and nozzles N1–N19 is connected in an air supply cirucit 177 under control of an air-operated valve 179. For raising the crosshead, valve 179 is activated to deliver air to the upper end of the cylinder and exhaust air from its lower end, the piston of the cylinder being stationary, and for lowering the crosshead, valve 179 is deactivated to deliver air to the lower end of the cylinder and exhaust air from its upper end. Control air is adapted for delivery to valve 179 at a port 181 via an air line 183 from a valve 185 controlled by the controller 171 via a line 187 and for delivery to valve 179 at a port 189 from a valve 191 controlled by the controller 171 via a line 193. The cylinder 39 has air-operated exhaust valves 195 and 197, the first of these being connected for delivery of control air via a line 199 from an air valve 201 controlled by the controller 171 via an electrical line 203 and the second being connected for delivery of control air via a line 205 from an air valve 207 controlled by the controller 171 via an electrical line 209. At 211 is indicated a switch interconnected at 213 with the controller 171 for turning it on and off under control of air valves 215 at opposite ends of the cabinet, these valves having push buttons operable by the palms of the hands and being connected in a control air circuit indicated at 217. Both buttons must be pressed in for actuating switch 213. The stepping motor 123, which drives the screw 115 for traversing the carriage 9 carrying the case holder 13 and which is coupled to the screw by a flexible coupling 219 (see FIG. 2), is under control of a second programmable logic controller 221. The latter functions to control the motor according to a program to be described in coordination with the program established by controller 171 for operation of the air-operated components of the apparatus including valves V1–V4 and the cylinder 39 for raising and lowering these valves. The two controllers are interconnected as indicated at 223 for such coordination. The motor is connected in a power circuit 225 under control of the controller 221 which functions to control motor direction and timing of motor operation. This circuit includes a limit switch 227 engageable by the carriage 9 as it moves out to determine the home position of the carriage. At 229 us indicated a runaway switch which acts to cut off the power to the motor if it should drive the carriage too far rearward. The electrical components may be protected by a purge-type explosion proofing system such as indicated at 230, details of which are not essential to an understanding of the apparatus.

At 231 is generally indicated means for effecting flushing of adhesive from the valves V1–V4, the manifolds M1–M4 and the nozzles N1–N19. This means comprises the shut-off valves 139 and 147 and a by-pass line 233 connected to line 135 upstream from valve 139, connected to line 143 downstream from valve 147 and itself including a shut-off valve 235. Valve 235 is normally closed and is opened for flushing. A line 237 including a pressure regulator 239 is connected to line 135 upstream from regulator 137 and to line 233 at a point between line 135 and valve 235.

The operation of the apparatus for effecting application of adhesive to 5.56 mm. caliber cartridge cases is as follows, the controllers 171 and 221 being programmed for movement of the case holder 13 and delivery of metered shots of adhesive in the sequence to be described. The pressure vessel 57 is charged with adhesive by turning off the pressure air to the vessel at valve 139, shutting off adhesive line 143 at valve 147, removing the lid 59, and pouring in the adhesive. The lid is replaced and valves 139 and 147 are opened for delivery of air via line 135 to the vessel for pressurizing the adhesive for delivery of the adhesive via line 143 etc. to the valves V1–V4. A case holder 13, loaded with 5.56 mm. cases C in the nineteen by seventeen format is applied to the carriage 9, which is back in its rearward retracted (home) position such as shown in FIGS. 1 and 2 and in solid lines in FIG. 3. With the carriage 9 and holder 13 back in the retracted position, the first row R1 of cases in the holder is spaced back from the vertical transverse plane of the nineteen nozzles N1–N19 a distance X (see FIG. 2). The crosshead 33 is in its raised position as shown in FIG. 3 wherein the lower ends of the nozzles N1–N19 are above the level of the upwardly facing top surface of the top plate P4 of the plate assembly P1–P4 constituting the case holder, the nineteen nozzles being for application of adhesive to 5.62 mm. caliber cases. A cycle of operation is initiated by the operator of the apparatus actuating the valves 215 (both of which must be actuated), starting operation through a series of steps, the first step of which is operation of the motor 123 under control of controller 221 for an interval to drive the screw 115 through a predetermined number of revolutions in the forward direction to index the case holder forward through the distance X to bring the first row R1 of cases C into the vertical plane of the nineteen nozzles N1–N19 with each of the nineteen cases in row R1 vertically coaxial with a respective nozzle.

Figure 13:
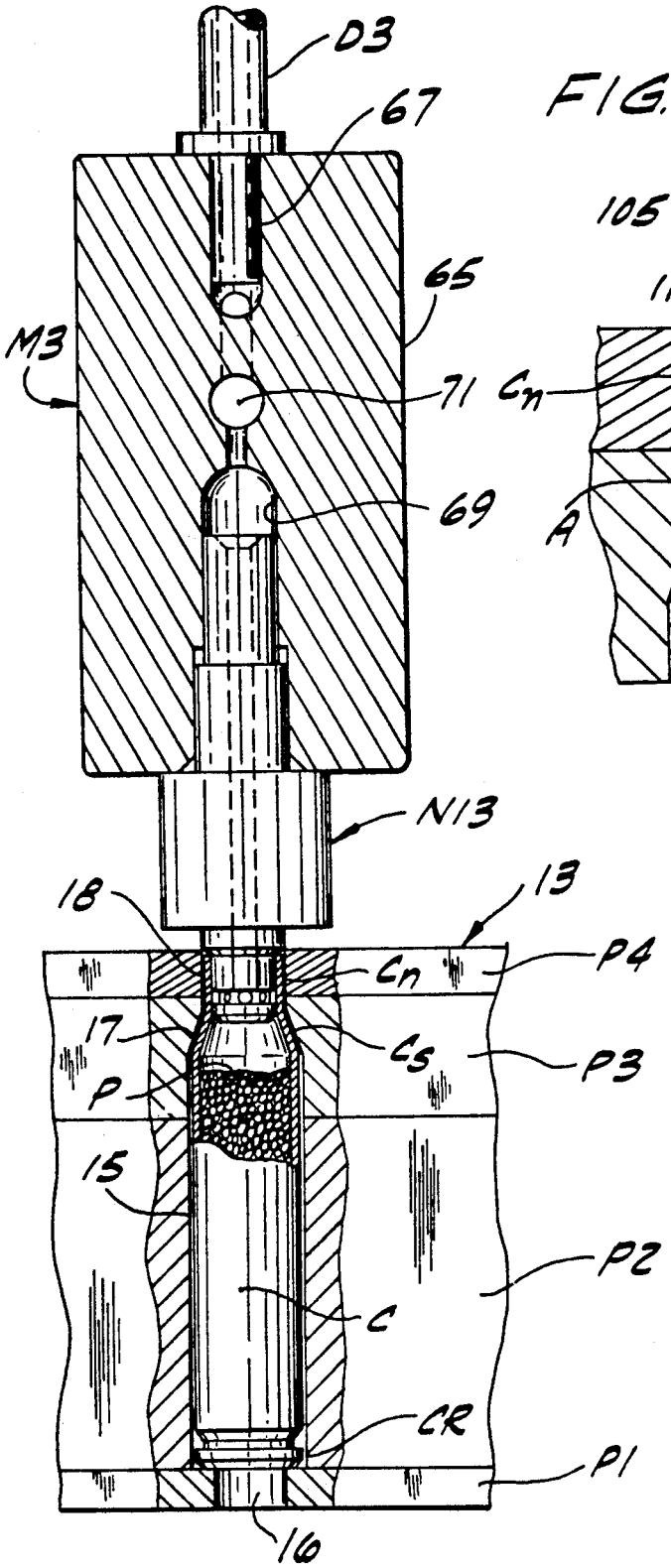
FIG. 13 is an enlarged view on line 13—13 of FIG. 5 showing the nozzle in its fully lowered position in the neck of a cartridge case.

With the nineteen nozzles N1–N19 aligned with the nineteen cases in the first row R1 of cases, the motor stops and the controller 171 signals valves 185, 191, 201 and 207 to effect delivery of air to the upper end of cylinder 39 and exhaust of air from its lower end, thereby driving the crosshead 33 carrying the valves V1–V4, manifolds M1–M4 and the nozzles N1–N19 down to the lower limit of the crosshead downstroke wherein the nineteen nozzles have their tips 103 entered in the necks Cn of the nineteen cartridge cases C in row R1 (as illustrated for one nozzle and case in FIG. 13). The chamfer 105 at the root of the tips of the nozzles contacts the upper end edge or mouth edge of the cases, sealing them for the ensuing delivery of adhesive and "mouth-ironing" those cases which need it, if any. At this point, the controller 171 sends a signal to valve 169 via line 175 to open and transmit pilot air to valve 153 to open the latter. This results in delivery of pilot air via line 155 and branch lines 157 to the four valves V1–V4 and exhaust of air from the valves via branch lines 161 and line 159 to open the four valves V1–V4 for delivery of adhesive through the valves V1–V4 and the four manifolds M1–M4 to and through the nineteen nozzles N1–N19. The delivery to the valves is from the pressure vessel via the line 143 and branch lines 145 (valve 147 and valve 149 being open). It is timed for delivery generally of a predetermined metered quantity of the adhesive, e.g. for 0.2second. As to each nozzle, the adhesive is delivered down through the axial passage 107, in the nozzle and out through the radial ports 109 to the circumferential annular recess or groove 111 in the tip 103 of the nozzle.

Figure 14:
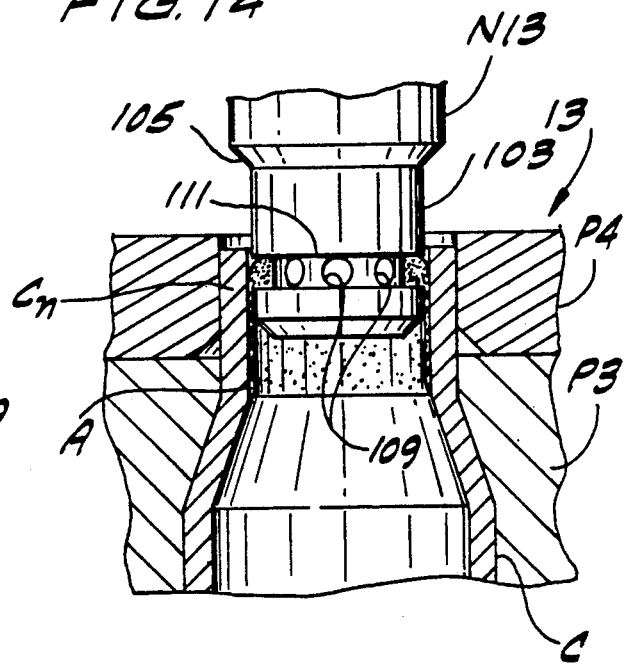
FIG. 14 is an enlarged fragment of FIG. 13 showing the nozzle moved upward and illustrating how it wipes adhesive on the inside surface of the neck of the case.

The controller 171 then functions to reverse the action of the valve 179 to cause the action of the cylinder 39 to be reversed to raise the crosshead 33, the valves V1–V4 and the nozzles N1–N19, bringing the tips 103 of the nozzles up out of the necks Cn of the nineteen cases in row R1. The delivery of the adhesive to the grooves 111 of the nozzles occurs during the withdrawal of the nozzles tips 103. The controller functions to effect closure of the valves V1–V4 to cut off delivery of the adhesive somewhat before the grooves 111 in the tips 103 of the nozzles pull up out of the case necks Cn. As the tips 103 of the nozzles slide up in the case necks, they wipe adhesive A exuded from the nozzle grooves 111 up along the interior surface of the necks (see FIG. 14). As noted above, each of the valves V1–V4 is of a type which functions to snuff back the adhesive when the valve closes, and this confines the application of the adhesive to the inside cylindrical surface of the case necks Cn, avoiding dribbling of adhesive.

When the crosshead 33 has been fully raised for fully raising the nozzles N1–N19 to their raised retracted position wherein their lower ends are above the level of the top of the case holder 13, the controller 221 effects operation of the motor 123 to drive the screw 115 through a predetermined number of revolutions in the forward direction to index the case holder forward the distance Y between rows R to bring the second row of cases R2 into the vertical plane of the nineteen nozzles N1–N19 for the applicaiton of adhesive in the necks Cn of the nineteen cases C in row R2. The application to the cases in row R2 takes place in the same manner as above-described for the application to the cases in row R1, and the process is repeated for the cases in rows R3–R17, the case holder 13 being indexed forward in steps corresponding to the longitudinal spacing Y of the rows. When the application of adhesive to the necks Cn of the cases C in the last row R17 has been completed, the controller 221 functions to effect operation of the motor 123 to drive the screw 115 in the reverse direction to drive the carriage 9 and the case holder 13 back to the home position. The case holder 13 is then removed from the carriage, and another holder 13 loaded with cases C is applied to the carriage for application of adhesive to these cases in the same manner as above described.

As above described, the case holder 13 is one that holds three hundred and twenty-three 5.56 mm. caliber cartridge cases in a nineteen by seventeen rank and file format. The apparatus is also adapted for operation to apply adhesive in the open ends of 7.62 mm. caliber cartridge cases utilizing a second set of nozzles adapted to fit in the necks of the 7.62 mm. cases, and a second case holder similar to the case holder 13 above described but adapted to hold 7.62 mm. caliber cases in a nineteen by thirteen rank and file format with the nineteen cases in each row or rank spaced the same as in the 5.56 mm. caliber case holder for alignment with the nozzles. Each of the controliers 171 and 221 has a second program for controlling the operation for application of adhesive to the 7.62 mm. caliber cases, the second program being adapted to effect indexing of the carriage 9 and case holder 13 through thirteen steps for the thirteen rows R of cases C and then to effect the return of the 7.62 mm. case holder through a lesser distance than the return of 5.56 mm. caliber case holder.

For treatment of the 7.62 mm. caliber cases C loaded in the 7.62 mm. caliber case holder, the 5.56 mm. caliber nozzles N1–N19 are removed (threaded out) of the manifolds M1–M4 and are replaced by the nineteen 7.62 mm. caliber nozzles of the second set. The apparatus is switched from the 5.56 mm. caliber program by suitable switching means to the second 7.62 mm. caliber program, the 7.62 mm. caliber case holder is applied to the carriage 9, and the operation then proceeds essentially in the same manner as for the treatment of 5.56 mm caliber cases.

For flushing adhesive out of the lines leading to the valves V1–V4 and out of these valves, the manifolds M1–M4 and the nozzles N1–N19, means is provided for collecting adhesive flushing out of the nozzles, valves 139 and 147 are closed. Valve 153 is actuated by delivery of control air to port 165 via a line 241 to opne the valves V1–V4, and valve 235 is opened for delivery of air to flush out lines 143 and 145 and the valves V1–V4, the manifolds M1–M4 and the nozzles N1–N19.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for applying a fluid adhesive to the inside surface of cartridge cases adjacent their open projectile-receiving ends preparatory to insertion of projectiles therein to provide a seal between said surface and the projectile, said apparatus comprising:

a set of adhesive dispensing nozzles at an adhesive applying station, means mounting the set of nozzles for movement between a raised position for bringing a set of cases under the nozzles and a lowered position wherein the nozzles are entered at their lower ends in the open upper ends of said set of cases, means for moving said nozzle mounting means up and down for raising and lowering the nozzles, a source of adhesive under pressure, means interconnecting said source and said nozzles including valve means for on-off control of flow of adhesive from the source to the nozzles, means operable with the nozzles raised for bringing a set of cases into position under the nozzles at the adhesive applying station, each nozzle being formed adjacent its lower end with a peripheral recess nd having passages for delivery of adhesive to said recess, and means for controlling the valve means to deliver adhesive to the recess of each nozzle for wiping of the adhesive on said inside surfaces of the cases as the nozzles are raised, and wherein each nozzle has a head having a lower end and a cylindrical tip extending down from the lower end of the head, the tip being of slightly smaller diameter than the inside diameter of the cartridge case at the open end of the case, the nozzle further having a chamfered root section between the upper end of the tip and the lower end of the head for mouth-ironing any case which may need it, the peripheral recess being in said tip, said passages providing for delivery of adhesive down through said head and tip to said recess.

2. Apparatus as set forth in claim 1 wherein the valve means comprises a plurality of valves, each feeding a plurality of nozzles, each valve being operable when actuated to cut off flow of adhesive and to snuff back adhesive from the nozzles fed thereby.

3. Apparatus as set forth in claim 1 wherein said cylindrical lower end portion is cylindrically shaped for entry into the open upper end of a case at the adhesive applying station, and said nozzle further includes a longitudinal passage for adhesive extending down through the nozzle terminating short of its lower end, and said peripheral recess is an annular peripheral groove in said cylindrical lower end portion, and said passages are radial ports extending from said longitudinal passage to the groove.

4. Apparatus as set forth in claim 1 wherein the nozzles are arranged in a row in a generally vertical plane at said adhesive applying station, wherein the means for bringing a set of cases under the nozzles at station comprises a carriage movable linearly in a generally horizontal path generally at right angles to said plane and means on the carriage for holding a plurality of cases on end mouth end up with the cases arranged in rows extending transversely of the path of the carriage, the cases in each row being spaced at intervals corresponding to the spacing of the nozzles, and said apparatus having means for indexing the carriage forward when the nozzles are raised to bring each successive row of cases under the nozzles.

5. Apparatus for applying a fluid adhesive to the inside surface of cartridge cases adjacent their open projectile-receiving ends preparatory to inserting of projectiles therein to provide a seal between said surface and the projectile, said apparatus comprising:

a set of adhesive dispensing nozzles at an adhesive applying station, means mounting the set of nozzles for movement between a raised position for bringing a set of cases under the nozzles and a lowered position wherein the nozzles are entered at their lower ends in the open upper ends of said set of cases, means for moving said nozzle mounting means up and down for raising and lowering the nozzles, a source of adhesive under pressure, means interconnecting said source and said nozzles including valve means for on-off control of flow of adhesive from the source to the nozzles, means operable with the nozzles raised for bringing a set of cases into position under the nozzles at the adhesive applying station, each nozzle being formed adjacent its lower end with a peripheral recess and having passages for delivery of adhesive to said recess, and means for controlling the valve means to deliver adhesive to the recess of each nozzle for wiping of the adhesive on said inside surfaces of the cases as the nozzles are raised, said nozzles being arranged in a row in a generally vertical plane at said adhesive applying station, the means for bringing a set of cases under the nozzles at said station comprising a carriage movable linearly in a generally horizontal path generally at right angles to said plane and means on the carriage for holding a plurality of cases on end mouth end up with the cases arranged in rows extending transversely of the path of the carriage, the cases in each row being spaced at intervals corresponding to the spacing of the nozzles, and said apparatus having means for indexing the carriage forward when the nozzles are raised to bring each successive row of cases under the nozzles, wherein the carriage is indexable forward from a retracted position first to bring the leading row of cases under the nozzles, then indexable forward in steps corresponding to the spacing of the rows to bring each successive row of cases under the nozzles, and movable back to retracted position following application of adhesive to the last row of nozzles.

6. Apparatus as set forth in claim 5 wherein the nozzle mounting means is constructed and arranged for application thereto and removal therefrom of different nozzles for application of adhesive to cases of different calibers, and wherein the carriage is constructed and arranged for application thereto and removal therefrom of different case holding means for holding cases of the different calibers, the carriage and each case holder having interengageable registration means for application of each case holding means in registered position relative to the nozzles.

7. Apparatus as set forth in claim 6 wherein the nozzle mounting means comprises a crosshead extending over the path of the carriage transversely of said path, wherein the valve means comprises a plurality of valves mounted on the crosshead, and a plurality of manifolds, one for each valve, mounted on the crosshead and fed by a respective valve, each manifold having a plurality of nozzles extending downwardly therefrom.

8. Apparatus as set forth in claim 7 wherein the manifolds and the nozzles are contructed and arranged for application to and removal from the manifolds of nozzles of different sizes for application of adhesive to cases of different calibers.

9. Apparatus as set forth in claim 8 wherein each valve is operable when actuated to cut off flow of adhesive and to snuff back adhesive from the nozzles fed thereby.

10. Apparatus as set forth in claim 9 wherein said indexing means for the carriage comprises a nut secured to the carriage, an elongate screw extending through the nut, and a stepping motor for driving the screw, the crosshead extending over the screw.

11. Apparatus as set forth in claim 9 having means for selectively programming the apparatus for operation on one or the other of cases of two different calibers.

12. Apparatus as set forth in claim 11 having means for flushing adhesive out of the valves, manifolds and nozzles including means for cutting off the source of adhesive from the valves, means for holding the valves open, and means for delivering a flushing medium to and through the valves, the manifolds and the nozzles.

* * * * *

UNITED STATES PATENT AND TRADEMARK OFFICE

CERTIFICATE OF CORRECTION

PATENT NO. : 5,256,203

DATED : October 26, 1993

INVENTOR(S) : Thomas B. Moore, et al.

It is certified that error appears in the above-identified patent and that said Letters Patent is hereby corrected as shown below:

On title page, item [54] and col. 1,

In the first line of the title, "Adhesive" (first occurrence) should read ---Apparatus---.

Signed and Sealed this

Twelfth Day of April, 1994

*Attest:*

Bruce Lehman

BRUCE LEHMAN

*Attesting Officer*

*Commissioner of Patents and Trademarks*